United States Patent [19]

Whitacre

[11] 4,289,325

[45] Sep. 15, 1981

[54] SKATEBOARD

[76] Inventor: Robert J. Whitacre, 13231 42 NE., Seattle, Wash. 98125

[21] Appl. No.: 104,891

[22] Filed: Dec. 18, 1979

Related U.S. Application Data

[63] Continuation of Ser. No. 830,392, Sep. 6, 1977, abandoned, which is a continuation of Ser. No. 953,858, Oct. 23, 1978, abandoned.

[51] Int. Cl.[3] ..... A63C 17/02

[52] U.S. Cl. ..... 280/87.04 A

[58] Field of Search ..... 280/87.04 A

[56] References Cited

U.S. PATENT DOCUMENTS

| | | | |
|---|---|---|---|
| D. 242,735 | 12/1976 | Candler | 280/87.04 A |
| 3,235,282 | 2/1966 | Bostick | 280/87.04 A |
| 4,040,639 | 8/1977 | Scardenzan | 280/87.04 A |

*Primary Examiner*—Joseph F. Peters, Jr.
*Assistant Examiner*—Randall A. Schrecengost

[57] ABSTRACT

This skateboard has a central section which is supported by longitudinally spaced wheel units under its end portions. A forward extension unit connects with the forward end portion of the central section and is preferably of arcuate shape, in longitudinal section, and extends forwardly and upwardly. The length of the forward extension unit is in the order of about one-half the length of the central section. Connecting means, as holes, are provided in the forward extension unit so the lower end portion of an operator support rope may be connected with a selected one thereof and thus the angular relation of the support rope and the operator's arm engaging the rope to the plane of the forward extension and the central section may be maintained in the range of 60°, with a variation of plus or minus 7°, and this for all average people regardless of their individual heights. By maintaining the said angular relation of the support rope, a rider may lean backwards and strain against the support rope and then shift a part of his or her body weight in controlling the skateboard and maintain the desired angular relationship between the support rope to the skateboard. An operator of the skateboard enhances his or her body control of the skateboard by riding with both feet on the central section and with a portion of his or her body weight straining the operator support rope.

3 Claims, 6 Drawing Figures

SKATEBOARD

CROSS REFERENCE TO RELATED APPLICATION

The present application is a continuation of my application Ser. No. 830,392, filed Sept. 6, 1977, and now abandoned and is a continuation of my copending application, Ser. No. 953,858, filed Oct. 23, 1978 and now abandoned.

BACKGROUND OF THE INVENTION

While skateboards have been in existence for many years, only recently have they been developed to provide an extremely precise and skillful art. Now the wheels and the boards which they support for wheeled movement have been developed to a state that extremely high speeds and intricate maneuvers are attainable by skillful riders of skateboards. Also, the boards are extremely durable to resist damage thereto even at high speed and severe impact with other objects. However, instability and lack of means for coordinated control of the operator's body and the skateboard in prior skateboards are primarily due to the fact that the operator has had contact or connection with the skateboard only through his or her feet and this has limited the operator's coordination of body and skateboard due to the lack of adequate anterior-posterior support. Anterior-posterior support can be improved by providing a forward extension to the skateboard and a rope extending therefrom to the hand of the operator. The forward extension is provided with adjustable means so that the lower end portion of the support rope may be secured to a selected length of the forward extension. Such adjustable effective length may be obtained by a plurality of longitudinally spaced holes. Thus, with people of normal heighth variations, the angle of the support rope to the skateboard may be maintained at 60°, plus or minus 7°, regardless of the height of the operator of the skateboard. Such angle is of extreme importance as it permits body movement of the operator to control the skateboard and the same time the disposing of the center of gravity of one's body so the safest position of the body and maximum control of the skateboard can be simultaneously obtained.

The only prior art patents known to applicant or his counsel which are in any wise pertinent are: U.S. Pat. Nos. 4,040,639, issued Aug. 9, 1977; 3,990,713, issued Nov. 9, 1976; 2,198,667, issued Apr. 30, 1940; 1,179,496, issued Apr. 18, 1916; 3,235,282, issued Feb. 15, 1966; 3,565,454, issued Feb. 23, 1971; and 3,622,172, issued Nov. 23, 1971

SUMMARY OF THE INVENTION

An object of this invention is to provide a skateboard having a central section having a suitable wheel unit under each end portion thereof to provide the desired wheeled mobility. Next, a forward extension unit connects with the forward end of said central section. A support rope is connected with a forward portion of this extension unit. The forward extension unit extends forwardly and upwardly and to a distance in the order of one-half the length of the centrol section and is preferably arcuate in longitudinal section. A support rope is connected with this forward extension and at selected lengths thereof, the length depending upon the individual height of an operator. Thus, the angular relation of the support rope extending directly from and alined with an arm of the operator to the plane of the skateboard, is in the order of 60°, plus or minus 7°.

DESCRIPTION OF A PREFERRED EMBODIMENT

Figure 1:
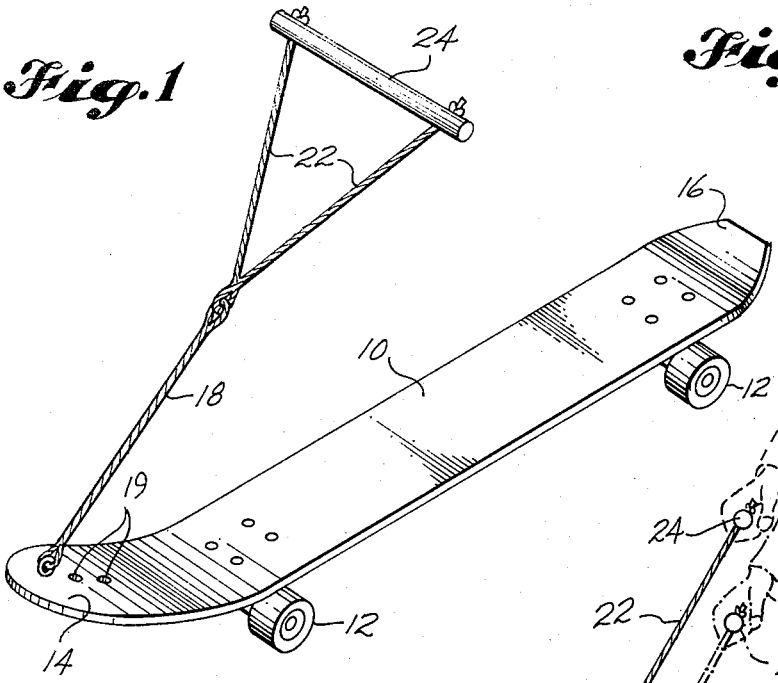
FIG. 1 is a perspective view of a skateboard embodying my invention and with the support rope shown in a position as it would be when held and so maintained by a rider.

The skateboard has a central section 10 and a wheel unit 12 is disposed on the underside and conventionally connected with each of the forward and rearward end portions of the central section 10 so that upon crosswise turning of the central section 10, turning movement of the skateboard results. Wheeled units come in various sizes and configurations for skateboards and this invention is not limited to any particular wheel unit. Also, the materials used in the construction of the central section 10, forward extension section 14 and rearward extension section 16 may follow the prior art. Some skateboards are constructed from laminated and glued together wood veneers, others of solid wood, others are made from suitable plastics, and others of metals.

The forward extension section 14 extends forwardly and upwardly from the central section 10 and is preferably of arcuate shape in longitudinal section. The lower end of the support rope 18 connects with a forward end portion of the forward extension section 14. A plurality of holes, rope connectors or other suitable means, as holes 19 are spaced longitudinally of forward extension 14 so the lower end portion of support rope 18 can be selectively connected to a longer or shorter effective length of forward extension 14.

Figure 2:
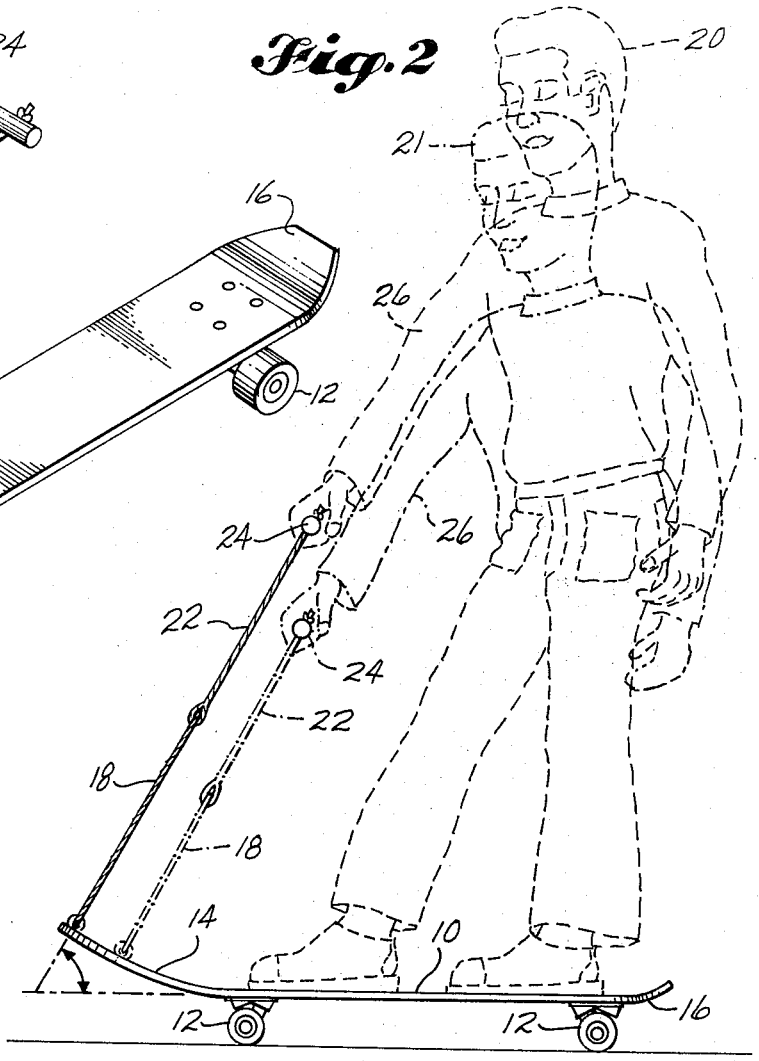
FIG. 2 is a perspective view, on a smaller scale, of the structure of FIG. 1, with two riders illustrated as riding said skateboard, a tall one by dash lines and a short one by dot-dash lines, and in each instance the angular relation of the support rope.
Figure 3:
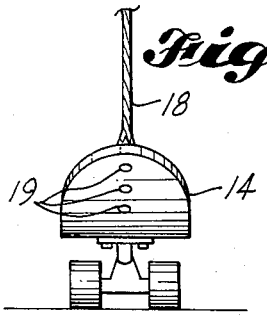
FIG. 3 is an end view and on a larger scale.
Figure 4:
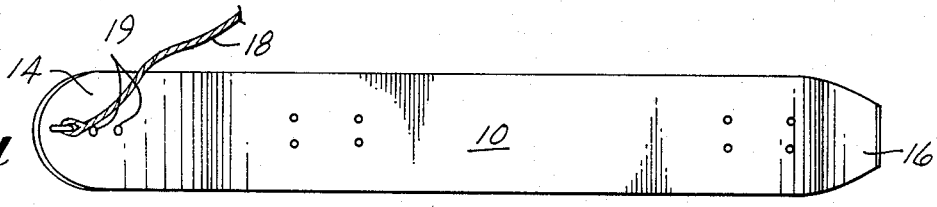
FIG. 4 is a plan view.
Figure 5:
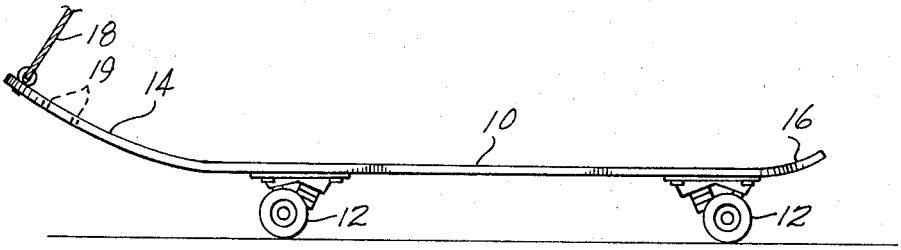
FIG. 5 is a view in side elevation.
Figure 6:
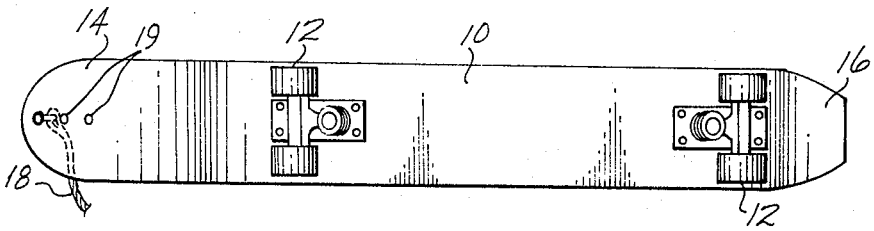
FIG. 6 is a bottom plan view.

To obtain the maximum advantages of my invention, an operator extends the arm used in manipulating the skateboard, directly toward the selected position of lower end of support rope 18 and with such arm and the support rope 18 alined. The hole 19 selected will depend upon the heighth of the rider. Thus, with the taller rider, illustrated by dash lines in FIG. 2, an opening 19 at the forward end of forward extension 14 is selected, while with a shorter rider, as illustrated by dot-dash lines in FIG. 2, a rearwardly positioned opening 19 is selected. With persons of normal height variations, an opening 19 may be selected so that the angular relation of the support rope 18 to the plane of the central section 10 of the skateboard will be in the order of 60° and should not vary therefrom by more than plus or minus 7°.

In riding a skateboard, the weight of the rider must be sufficiently disposed on the central section 10 to keep all wheels of units 12 firmly on the ground. Also, the weight must be sufficiently rearward so that a rider will not tumble forwardly upon the wheels 12 striking objects. Thus, a rider must lean backwards to some degree. Also, a rider must be able to shift his or her weight to one side or the other in steering the skateboard. When the support rope is grasped by a rider and the rider's arm and the support rope 18 are angularly disposed to the plane of the skateboard at an angle of substantially 60°, then there is a high degree of stability of rider and skateboard and maximum stability by the rider. This rider stability is directly related to the support rope 18 and its angular relation to the skateboard.

The arcuate shape of the forward extension 14 permits the desired angle of the rope 18 to the central section 10 with a shorter forward extension 14 than would be possible if the forward extension 14 were a continuation of the central section and in a common horizontal plane therewith. By having the forward extension 14 of substantial length and in the order of about one-half the length of the central section 10 and with holes 19, the desired angular relation of about 60° obtains for substantially all riders.

The support rope 18 preferably continues into a yoke or bifurcated portion 22 to support a handle 24 to be grasped with one or both hands of the operator.

In riding the skateboard, a taller operator, simulated by the dash lines figure 20, or a shorter operator, simulated by dot-dash line figure 21, stands on the board. A position of riding may be with the right leg extended forwardly, the right foot on the forward portion of the central section 10, the toes up to the wheel unit 12, the right foot parallel to the sides of the central section 10, and with the right knee straight, as shown. The left leg extends rearwardly, the left foot is on the central section 10, just behind the right foot, the left foot is parallel to the sides of the central section 10, and the heel of the left foot is up to the rear wheel unit 12. The support rope assembly 18, 22, 24 is under tension, the arm 26 of the operator (whether figure 20 or 21) is alined with support rope 18 and they both point toward the selected hole 19 to which the lower end of support rope 18 is attached. With either figure 20 or 21 (representing a tall or a short person), the angular relation of the support rope 18 to the central section 10 is 60° (plus or minus 7°). The operator applies tension to support rope 18 and by positioning of his or her weight and the center of gravity thereof, there is concomitant support of body and skateboard. For example, the operator can lean backwards and tension the support rope 18, 22, 24 in a posterior direction to obtain greater speeds and stability. Also, when it is desired to travel on a sinuous course, the operator may lean backwards and be supported by support rope 18, 22, 24 and may shift his or her weight from side to side to cause such travel. This feature is particularly significant during slower speed activities requiring high degrees of board and body control. A typical example is that of slow speed navigation of a slalom course with intricate maneuvers. The various intricate maneuvers mentioned are performed to the best advantage and the greatest safety with the skateboard of my invention as compared to prior art skateboards.

It is sometimes desired to support the skateboard solely on the rear wheel unit 12. This may be accomplished by carrying the weight of the operator on one foot, as the right foot, and by the tension applied on the support rope assembly 18, 22, 24. Then, the other, or left, foot is turned crosswise of the skateboard and rested when crosswise on the rear extension unit 16. The weight of the operator's body is gradually shifted from all on one foot, as the right foot, to the amount necessary on the other, or left foot, and on the rearward extension unit 16 until the central section 10 and the forward extension 14 form an acute angle to the ground. While this is being accomplished, tension is provided by the operator on the rope support assembly 18, 22, 24 and thus the skateboard is tilted the desired amount by shifting the desired amount of weight of the operator. After the skateboard has been so tilted, the appropriate turning movement of the operator and his or her body will cause the skateboard to turn while supported solely by the rear wheel unit 12. Due to the angular rearward and upward angle of the rear extension unit 16, a rather steep angle of the central section 10 and the skating surface may obtain without dragging of the rearward extension unit 16 on the skating surface, any dragging would tend to upset the skateboard operator and cause injuries.

Also, it is sometimes desired to support the skateboard solely on the front wheel unit 12. This may be accomplished by one foot on the central portion 10 and the gradual shifting of some of the weight of the operator to the other foot disposed on the forward extension 14 in a similar manner. Due to the angular forward and upward direction of the forward extension unit 14, rather steep angles may be obtained between the central section 10 and the ground surface without dragging of the forward extension 14 on the skating surface.

For strength and aesthetic purposes, it is desirable that the central section 10, forward extension section 14, and rearward extension section 16 be all formed contiguously as a unit regardless of the type of material from which the skateboard is constructed.

RESUME

By way of summary and briefly considered, I have provided a skateboard comprising a central platform section 10 and a skate wheel unit 12 carried by and disposed under each end portion of the central platform section 10. A forward extension section 14 is carried by and extends forwardly of the central section 10. This extension 14 is of a length in the order of one-half the length of the central section 10. As the operator places a portion of his or her weight in tension against the support unit 18, 22, 24, this tension causes forces in various directions while the operator shifts his or her weight. All these forces are reflected in the travel of the skateboard. A support rope comprising bifurcated rope 18, bifurcated portion 22, and handle 24 form a support assembly which is connected with a forward portion of the forward extension section 14 and is held at an angle of substantially 60°, plus or minus 7°, to the plane of the central section 10. By the use of the adjustment holes 19, the lower end of the support rope 18, may be attached to the forward extension 16 and the 60° angular relationship maintained regardless of the height of the rider.

Preferably, the forward extension section 14 is arcuate and extends forwardly and upwardly from the central section 10. Also, the rearward extension section 16 extends preferably rearwardly and upwardly from and is integral with the central section 10. This section 16 is also preferably arcuate in longitudinal section. Preferably, the units 10, 14, and 16 are formed integrally, both for strength and aesthetic reasons.

Obviously, changes may be made in the forms, dimensions, and arrangements of the parts of my invention without departing from the principle thereof, the above setting forth only a preferred form of embodiment of my invention.

I claim:

1. A skateboard comprising a central platform section; a skate wheel unit carried by and disposed under each end portion of said central section; a forward extension carried by and extending forwardly of said central section; connecting means for adjustably connecting with the forward extension and at selected portions of the length of such extension, said adjusting means comprising a plurality of longitudinally spaced openings in the forward extension; and a support rope connected with said connecting means, said support rope being connectable with a selected opening of said spaced openings in said forward extension to provide an angular relation of about 60° of the support rope to the central section, when the rope is gripped by a rider standing on the central section and with the rider's rope-engaging arm alined with the support rope, thereby providing enhancement of rider control of the skateboard and maintaining a certain angular relation of rope to rider with riders of varying heights.

2. The combination of claim 1, wherein the forward extension extends arcuately forwardly and upwardly.

3. The combination of claim 1, wherein the length of the forward extension is in the order of one-half the length of the central section.

* * * * *